US005205087A

United States Patent [19]

Jines

[11] Patent Number: 5,205,087

[45] Date of Patent: Apr. 27, 1993

[54] PORTABLE STAGING PLATFORM

[76] Inventor: Michael D. Jines, 144 14th St. NE., Owatonna, Minn. 55060

[21] Appl. No.: 652,889

[22] Filed: Feb. 8, 1991

[51] Int. Cl.[5] ..... E04B 5/00; E04H 3/10

[52] U.S. Cl. ..... 52/6; 52/586; 52/822; 52/126.5

[58] Field of Search ..... 52/6, 7, 8, 126.2, 126.5, 52/263, 586, 823, 821, 822, 281, 283, 285

[56] References Cited

U.S. PATENT DOCUMENTS

| | | | |
|---|---|---|---|
| 3,094,848 | 6/1963 | Albrech | 52/263 |
| 3,258,884 | 7/1966 | Wenger | 52/6 |
| 3,640,039 | 2/1972 | McKee et al. | 52/586 |
| 3,964,402 | 6/1976 | Jenné et al. | 52/584 X |
| 4,843,792 | 7/1989 | Rogers et al. | 52/263 |
| 4,942,708 | 7/1990 | Krumholz et al. | 52/263 |

*Primary Examiner*—David A. Scherbel
*Assistant Examiner*—Robert Canfield

[57] ABSTRACT

A portable, reconfigurable staging platform is provided and includes a plurality of individual panel assemblies, a plurality of support legs coupled to the panels, and a plurality of connectors for detachably coupling selected individual panels to one another in a desired configuration. Each of the individual panel assemblies includes a central panel region with a peripheral edge overlaid by a panel frame. The support legs are operably coupled to the frame and the frame includes a connector receiving feature for slidably, releasably receiving the connectors so that selected adjacent panels may be joined to each other.

3 Claims, 6 Drawing Sheets

PORTABLE STAGING PLATFORM

TECHNICAL FIELD

This invention relates to portable staging platforms. More particularly, the invention relates to a portable, lightweight, and stable staging platform that can easily be set up, broken down, and reconfigured into a variety of desired staging platform arrangements.

BACKGROUND OF THE INVENTION

Portable stage platforms or risers having separable stage units, each having a perimetral frame, and a clamp for engagement with adjacent frame members to hold the stage units locked to each other, are known. Examples of such stages are disclosed in U.S. Pat. Nos. 3,964,402, 4,930,277 and 4,942,708.

While the prior art, including the patents cited above owned by the assignee of the present invention, discloses improvements in portable, reconfigurable elevated floors or staging platforms, there is a continuous demand in the industry for lighter, sturdier, and more easily managed flooring systems. In particular, the support legs of portable staging platforms must be collapsible or removable. Often, however, a leg assembly designed for sturdiness will increase the weight of the overall platform, and the complexity of set up.

SUMMARY OF THE INVENTION

The problems and needs outlined above are in large part addressed by the lightweight portable staging platform in accordance with the present invention. The individual platform panels, and particularly the design of the supporting leg assemblies and the structure for joining adjacent platform panels, are lightweight, yet especially designed for rapid, easy reconfiguration of the staging platform and for maintaining the surface of joined, adjacent panels in horizontal, planar alignment.

Broadly, the present invention comprises a plurality of individual platform panels, a plurality of supporting legs coupled to the panels through unique bracket assemblies and a plurality of connectors for detachably coupling the supported individual panels to one another in a desired configuration. Each of the individual platform panels includes a central panel region with a peripheral edge cladded by a panel frame. The support legs are operably coupled to the panel frame in a simple to operate, yet sturdy bracket assembly and the frame includes a connector receiving feature for slidably receiving panel joining connectors.

DETAILED DESCRIPTION OF THE DRAWINGS

Figure 1:
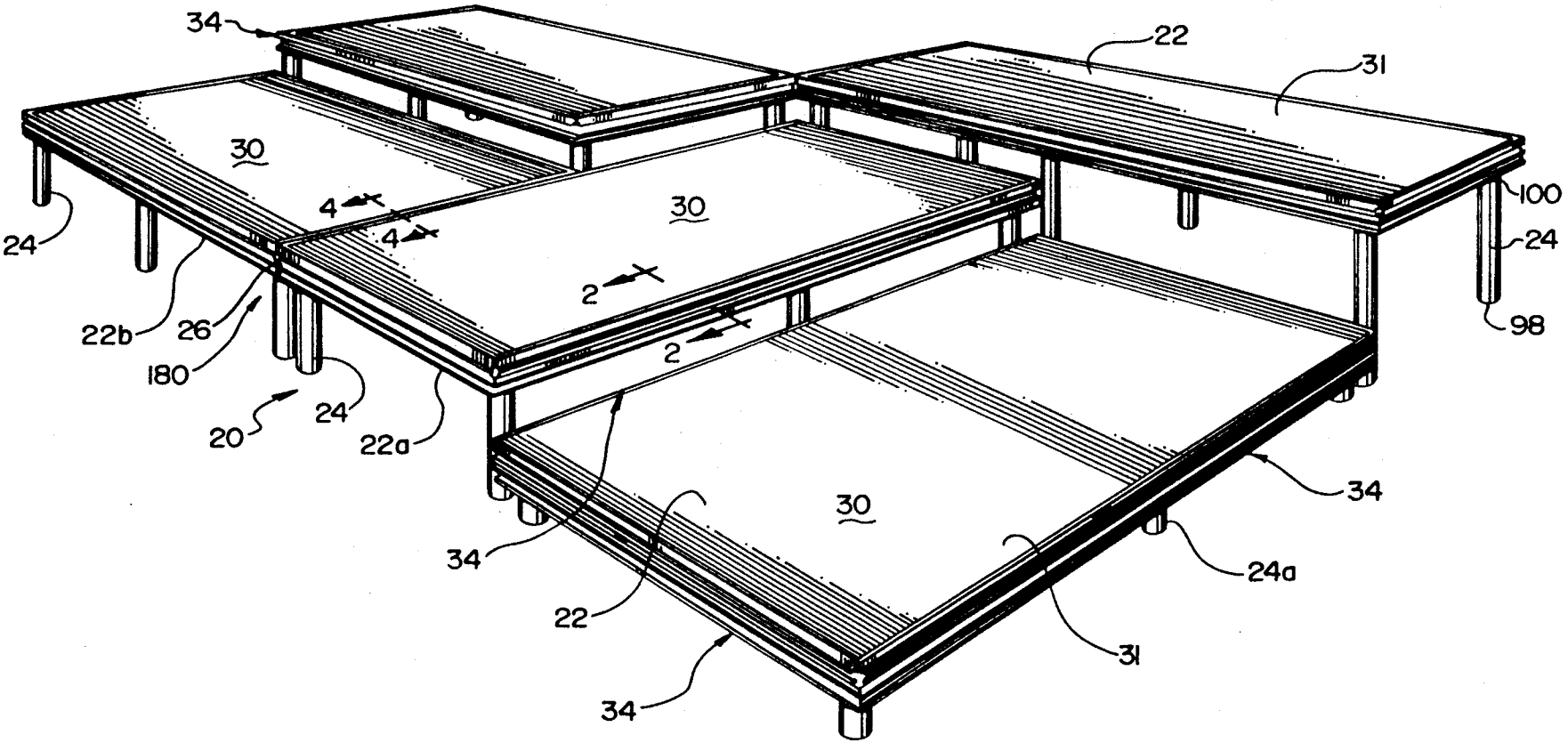
FIG. 1 is a perspective view of a staging platform in accordance with the present invention.

Referring to the drawings, a portable staging platform 20 in accordance with the present invention broadly includes a plurality of individual platform panel assemblies 22, a plurality of support legs 24, and at least one platform panel connector 26. The individual platform panel assemblies 22 making up the staging platform 20 are adjacent to each other and, referring to FIG. 1, are generally horizontal, yet may be disposed at various vertical heights relative to one another to produce a designed staging platform pattern.

Figure 2:
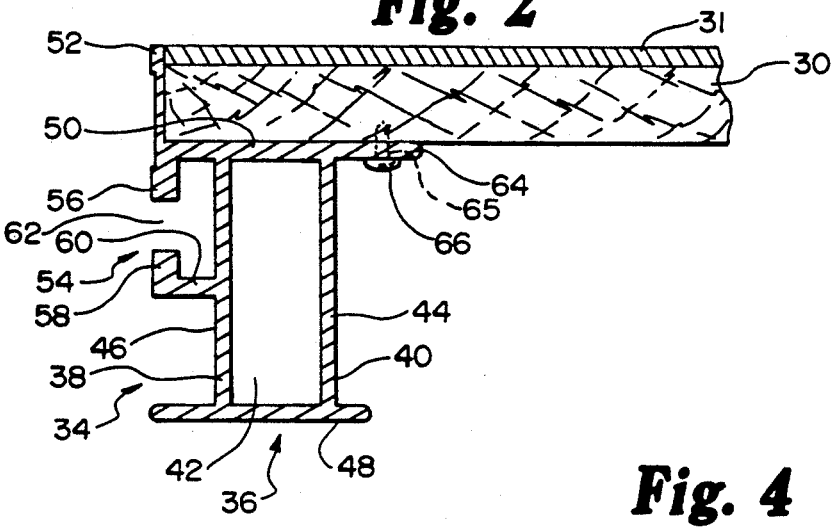
FIG. 2 is a fragmentary sectional view taken along the line 2—2 of FIG. 1.

Referring in particular to FIGS. 1 and 2, each of the platform panel assemblies 22 includes a central panel region 30 formed of a relatively low density or lightweight material, a platform covering 31 thereover, and a platform panel cladding frame 34 along each of panel region peripheral edges. The cladding 34 may be joined at the corners thereof by conventional fasteners, such as staple-type fasteners (not shown). The cladding 34 overlays the periphery of the panel assembly 22 and includes an upright, generally vertical central web 36 comprising a front support 38 and a rear support 40 and a hollow core 42. The central web 36 includes a panel facing side 44 of the rear support 40 and an outwardly facing, exposed side 46 of the front support 38. Upper and lower, generally horizontal flanges, including a lower or bottom flange 48 and an upper or top flange 50, extend laterally away from the central web 36. The upper and lower flanges 50, 48 define the upper and lower walls of the hollow core 42. An upstanding lip 52 extends generally vertically and upwardly away from the upper flange 50.

Suitable panel materials include low density, oriented-strand material, wood and wood products, and suitable plastics or vinyls. Suitable materials for the cladding 34 include various metals, metallic alloys or plastics. Aluminum, for example, may be extruded in continuous lengths and cut to size.

Adjacent the upper flange 50, the outwardly facing surface 46 of the central web 36 includes a keyway channel 54. A first key leg 56 extends downwardly from the upper flange 50 generally parallel to the front support 38. A second key leg 58 extends upwardly from a key leg base 60 that extends laterally from approximately the middle of the front support 38 between the upper and lower flanges 50, 48. An opening 62 is between the key legs 56, 58 and opens into the keyway channel 54.

The cladding 34, and specifically the upper flange 50, further includes a fastener flange 64. The fastener flange 64 may include a fastener receiving aperture 65 adjacent the end thereof. A fastener 66 inserted through the fastener flange 64 into the panel material forming the panel assembly 22. Referring to FIG. 2, the panel assembly frames 34 are secured to the edges of the panel assembly 22 by a plurality of fasteners 66, in this instance wood screws. Referring to FIG. 1, it will be seen that each frame 34 extends along the entire perimeter of the platform assemblies 22.

Figure 15:
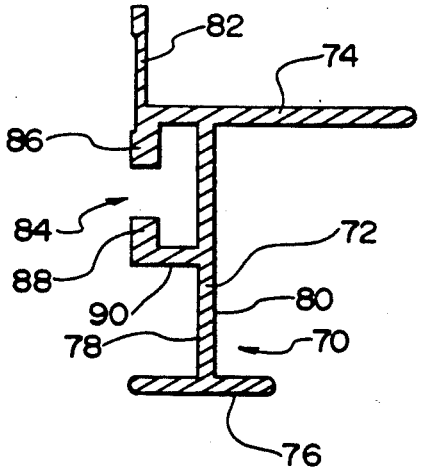
FIG. 15 is a sectional view depicting an alternate cladding embodiment.

A modified cladding frame 70 is depicted in FIG. 15. The cladding 70 comprises a central, generally vertical upstanding web 72. Upper and lower flanges 74, 76, respectively, extend laterally from the central web 72 at the upper and lower ends thereof. The central web 72 has an outwardly facing, exposed side 78 and a panel facing side 80. At one end of the upper flange 74 an upstanding, generally vertical lip 82. Beneath the upper flange 74, at the upper region of the exposed side 78 of the central web 72, the cladding 70 has a connector receiving channel 84. The channel 84 is formed by a descending channel leg 86 that depends from the upper flange 74 and a lower channel leg 88 that extends upwardly from a channel base 90. As with the frame 34 depicted in FIG. 2, the modified cladding 70 may extend substantially around the entire periphery of the platform assembly 22.

The platform supporting legs 24 each include a generally cylindrical tubular wall 94 and a hollow core 96. Each leg 24 includes a floor contacting end 98 and an upper end 100. The legs 24 are single pieces in selected lengths, but it is within the scope of the present invention that the legs 24 include telescoping length adjustment features or floor engaging feet (not shown).

The legs 24 are received in a leg bracket 102. The leg bracket 102 includes a pair of mounting shoulders 104, 106 that intersect at a right angle corner 108. A leg receiving collar 110 extends symmetrically from the mounting shoulders 104, 106 outwardly away from the corner 108.

Figure 6:
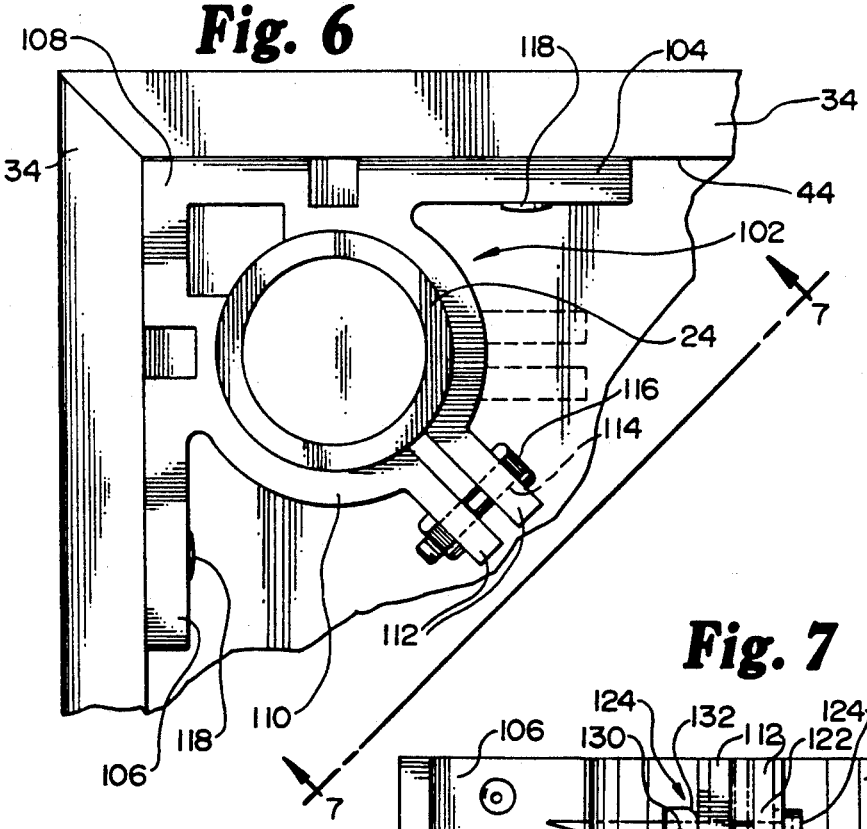
FIG. 6 is a fragmentary bottom plan view depicting a leg in a leg receiving bracket.

Referring to FIG. 6, the leg collar 110 includes a pair of collar lips 112. The lips 112 include an aperture 114 for receiving a tightening screw or bolt 116. An alternative location for the lips 112 is depicted in phantom; the lips 112 may be selectively positioned about the leg receiving collar 110 between the mounting shoulders 104, 106. The leg bracket 102 is riveted to the panel facing side 44 of the rear support 40 of the platform frame 34 by rivets 118.

The leg bracket mounting shoulders 104, 106 may be oriented generally coplanar for attachment to platform assembly 22 away from a corner thereof, as depicted at **24*a* in FIG. 1**.

Figure 7:
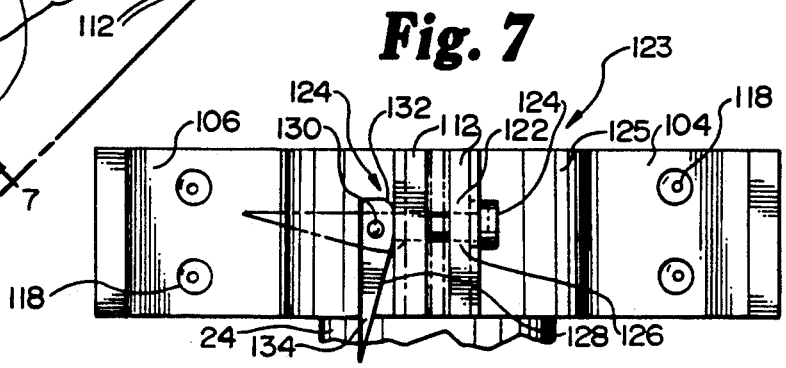
FIG. 7 is an elevational view taken from the perspective of line 7—7 of FIG. 6.

A second embodiment of a leg bracket 123, having an alternate tightening means 124 for tightening the collar 125 about the leg 24, is depicted in FIG. 7. Specifically, a tightening pin 122 takes the place of tightening screw 116. The tightening pin 122 includes a pinhead 124, a shank 126 and a tightening lever 128 pivotally pinned by pivot pin 130 adjacent the end of the shank 126. The tightening lever 128 includes a rounded portion 132 and an arm 134.

Figure 12:
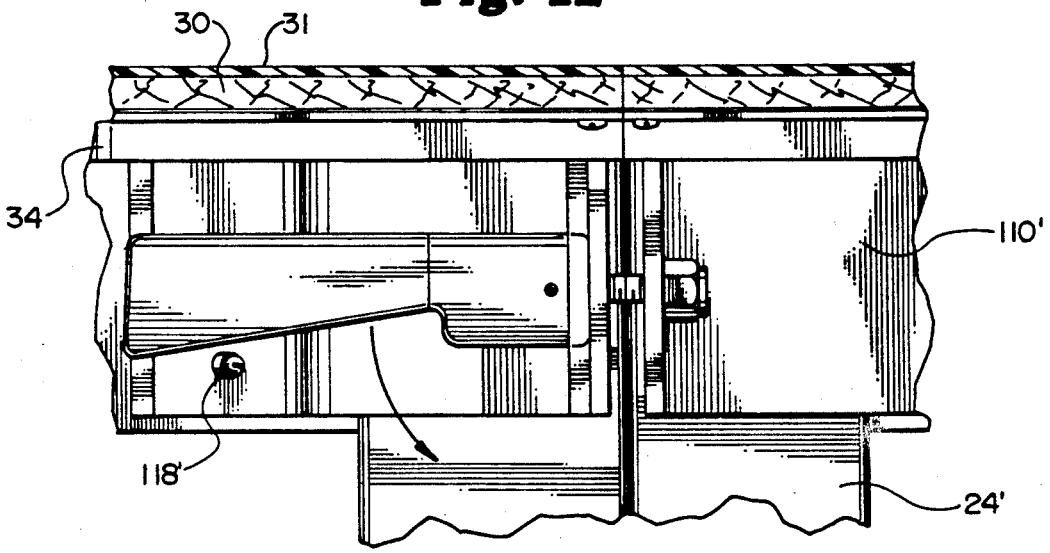
FIG. 12 is a fragmentary elevational view of an alternative embodiment of a leg bracket in accordance with the present invention.
Figure 13:
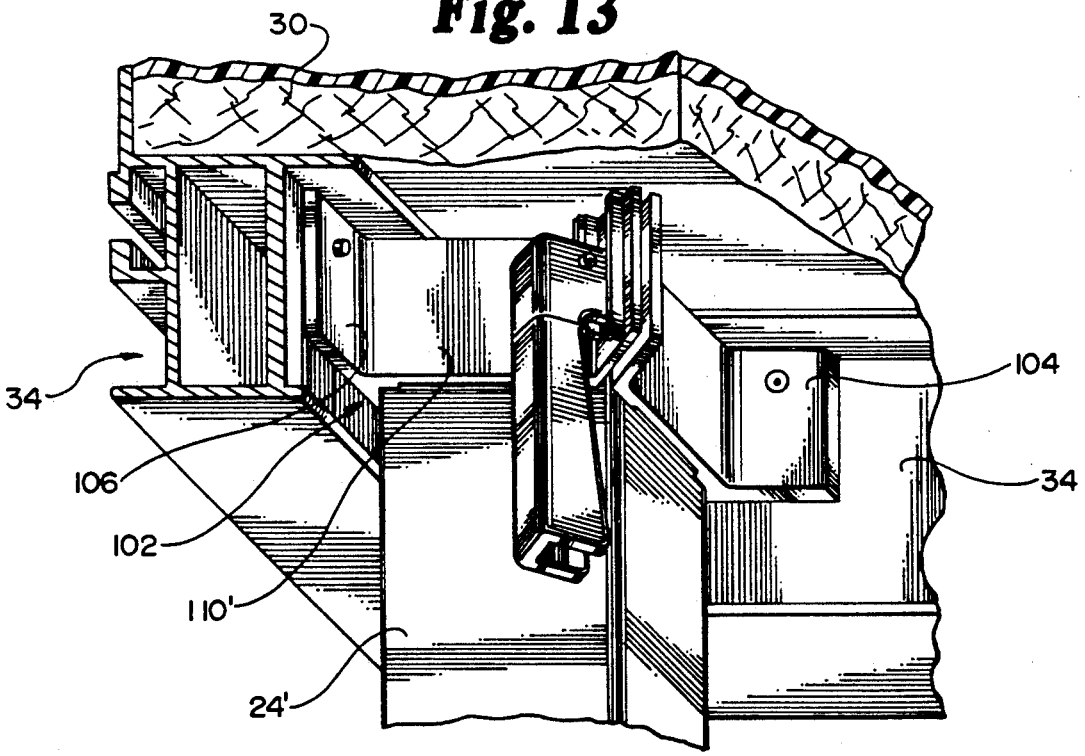
FIG. 13 is a fragmentary perspective view of the leg bracket depicted in FIG. 12.
Figure 14:
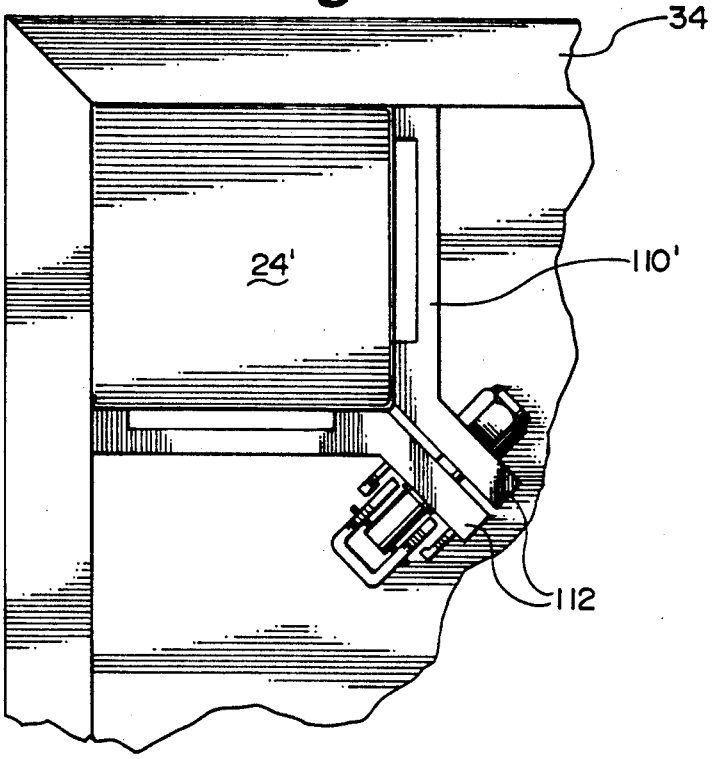
FIG. 14 is a top plan view depicting the leg bracket of FIGS. 12 and 13 installed at a panel frame corner.

A third embodiment of a leg 24' and leg bracket 110', is depicted in FIGS. 12, 13 and 14. The leg 24' has a polygonal, rather than cylindrical configuration. Similarly, to compliment the leg 24', the leg bracket 110' has a like polygonal configuration; a generally rectangular configuration is depicted.

A modified collar tightening pin and lever arrangement 224 depicted in FIGS. 12–14 includes a pin 224, a pin cap nut or head 226 and a locking lever 228. The lever 228 has an over-the-center pivot block 230, whereby the arrangement 224 may be locked in tightened relation. Referring to FIG. 16, yet another modified leg bracket 202 is depicted. The bracket 202 may be extended upwardly and/or downwardly along its longitudinal axis and the mounting shoulders 104, 106 also may be extended (depicted in phantom).

Figure 4:
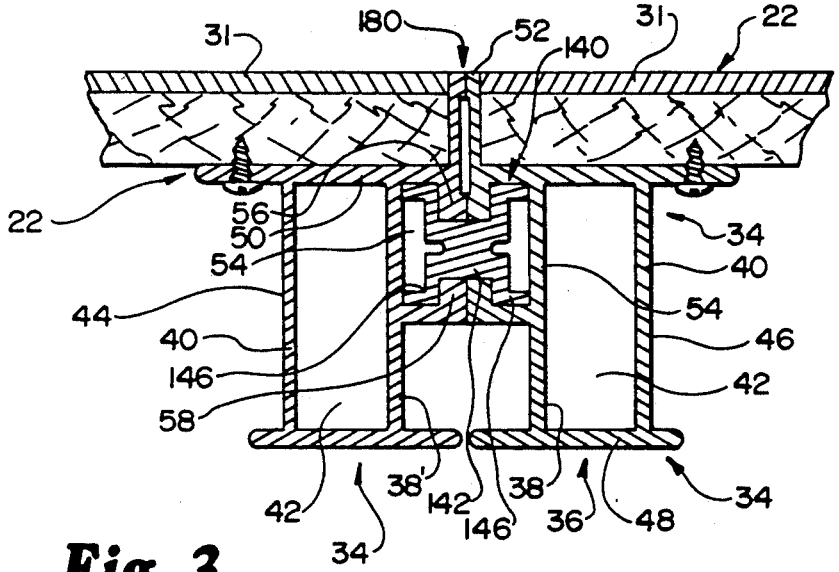
FIG. 4 is a fragmentary sectional view taken along the line 4—4 of FIG. 1.
Figure 3:
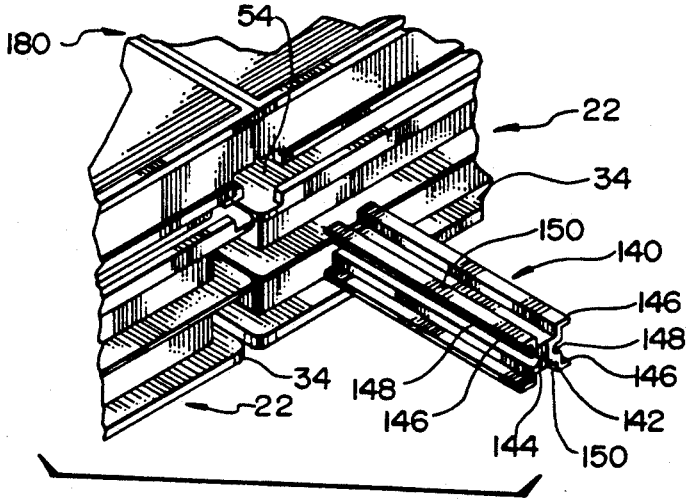
FIG. 3 is a fragmentary perspective view, partially exploded, of two adjacent panels and a key connector.

Referring to FIGS. 3 and 4, a connector key 140 connects two adjacent panel assemblies 22, and particularly, two adjacent platform frames 34. The connector 140 has an elongated, generally H-shaped body 142. The body 142 includes a central web 144 and four arms 146 extending generally diagonally from the body 142 at the corners thereof. On two of the sides of the body 142 between the arms 146, the key connectors 140 include a tool channel 148. On the other two opposed sides of the body 142, the connectors 140 include an elongated key leg receiving channel 150.

Figure 10:
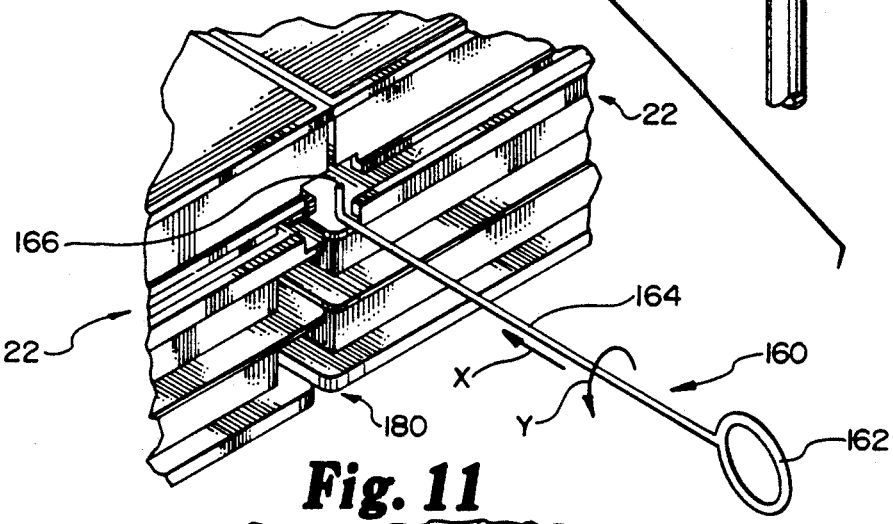
FIG. 10 is a fragmentary exploded perspective view depicting a connector tool with arrows depicting the insertion motion thereof.
Figure 11:
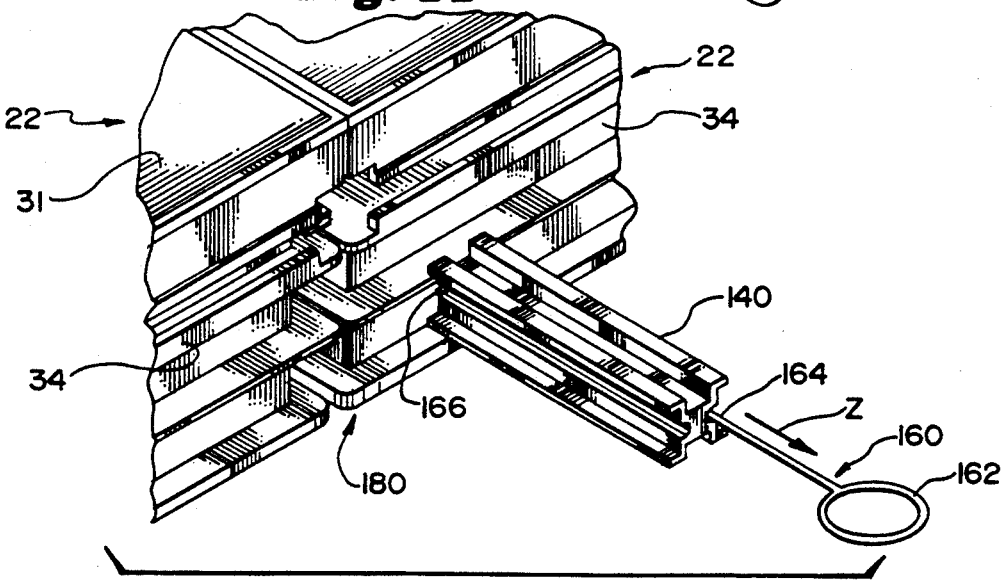
FIG. 11 is a fragmentary exploded perspective view depicting the connector in accordance with the present invention removed from adjacent platform panels.

A connector hook tool 160 for manipulating the connector keys 140 is depicted in FIGS. 10 and 11. The hook tool 160 includes a finger ring 162, an elongated shank 164 and a hook end 166 at the end of the shank 164 opposite the finger ring 162.

Figure 8:
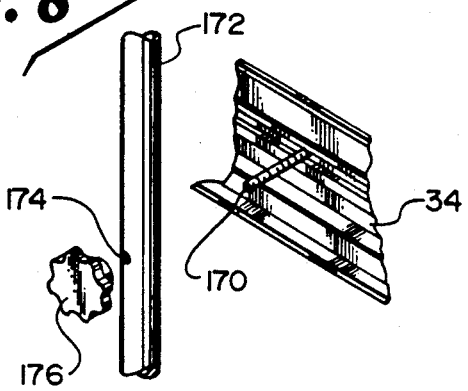
FIG. 8 is a fragmentary, exploded perspective view depicting a rail post and platform frame.
Figure 9:
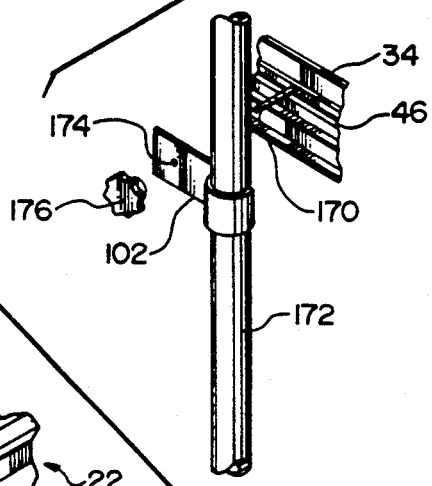
FIG. 9 is a fragmentary, exploded perspective view showing an alternative embodiment of the rail post depicted in FIG. 8.

Referring to FIGS. 8 and 9, the panel frame 34 may include a selected number of connecting screws 170. The connecting screws 170 extend laterally and outwardly away from the exposed side 46 of the platform frame 34. A rail post 172 having a connecting screw receiving aperture 174 may be mounted to the platform frame 34 on the connecting screw 170. A tightening knob 176 is threadably received on the connecting screw 170 and may be tightened to hold the rail post 172 after it is in place. FIG. 9 depicts a leg support bracket 102 used to secure the rail post 172 or other standards (not shown) to the platform frame 34.

A joint 180 between two adjacent panel assemblies 22 is depicted in FIGS. 1 and 4. Specifically, the key connector 140 compliments the configuration of the adjacent keyways 54 in each of the panel frames 34. The central body 142 of the connector 140 is received generally centrally between the key legs 56,58 and the key arms 146 are received in the keyways 54. The key connector 140 fits closely within the keyways 54 of each panel frame 34.

Assembly of a staging platform 20 in accordance with the present invention is accomplished by initially manufacturing the individual platform panel assemblies 22. A selected platform board material for forming the central region 30 of the panel assembly 22 is cut to the desired size. The edges of the material are cladded or overlaid with the panel frame 34 by attaching the frame 34 at the peripheral edge and to underside of the board material, whereby the upper flange 50 and lip 52 contact the board material. Suitable fasteners, such as wood screws 66, may be used to fasten the frame 34 to the board material. A platform covering 31 of suitable composition may be used to overlie the board material.

Figure 5:
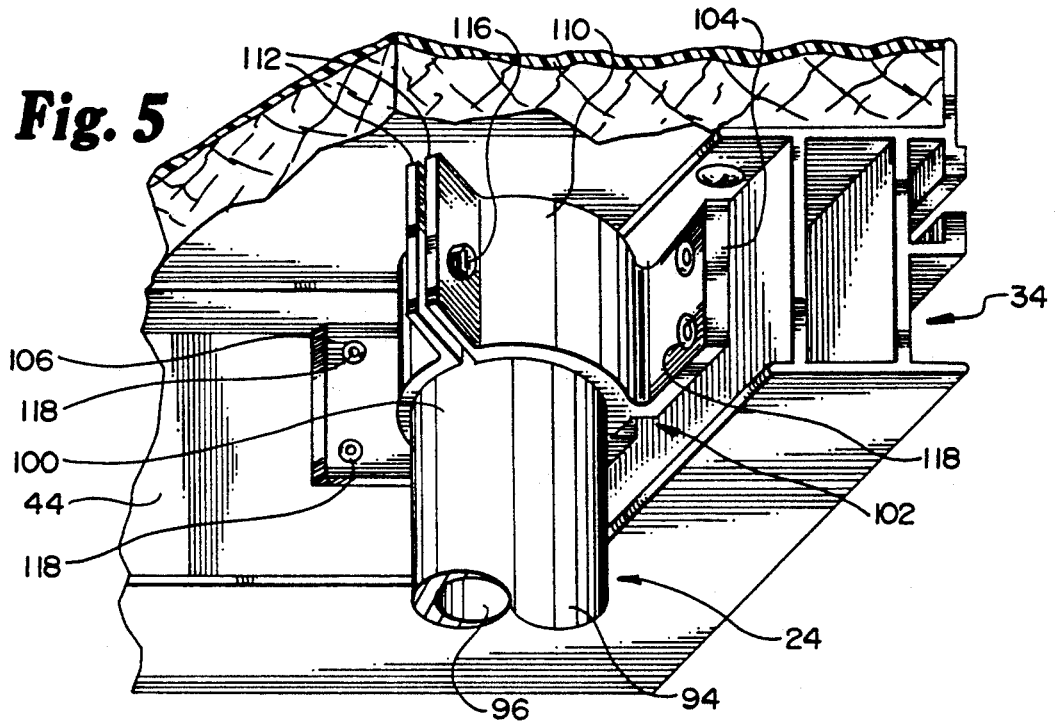
FIG. 5 is a fragmentary perspective view depicting a support leg connected to a platform frame by a bracket assembly.

Referring to FIGS. 1 and 5, an appropriate number of legs 24 may be selected. Typically, one leg 24 will be used in each panel assembly corner with at least one additional leg generally centrally positioned on the longer sides of the assembly 22. A number of leg brackets 102, complimentary to the selected number of legs 24, may be attached by rivets 118 to the inner or panel facing side 44 of the frame 34; rivets 118 are but one suitable method for attaching of the leg brackets 102. The upper ends 100 of the legs 24 are slidably received in the leg collars 110 and the collars 110 may be tightened. Referring to FIG. 1, legs 24 of various lengths are used to create a multi-level design for a staging platform 20.

Referring to, particularly FIGS. 1, 3, and 4, the key connectors 104 in accordance with the present invention are used to form a joint 180 between adjacent panel assemblies 22. The key connector 140 is aligned with the parallel keyways 54 of adjacent panel assemblies 22 and slidably placed therein by hand. The close fit of the complimentary surfaces of the generally H-shaped connector 140 and the parallel keyways 54 ensures that adjacent platforms (platform assemblies 22*a* and 22*b* in FIG. 1) will be held tightly adjacent and that the upper surface of the assemblies 22 will remain generally coplanar and in horizontal alignment.

Hook tool 160 is used for rapidly disassembling the staging platform 20. The hook tool 160 may be inserted along the path of travel indicated by arrow X in FIG. 10 into the portion of the keyway 54 unoccupied by the body 142 of the key connector 140. The hook tool 160 is then rotated as depicted by arrow Y. This motion brings the hook end 166 across the innermost end of the key connector 140. Referring to FIG. 11, arrow Z indicates the motion for withdrawing the key connector 140 from the joint 180 between adjacent panel assemblies 22.

After the key 140 has been withdrawn, the light weight panel assemblies 22 may be reconfigured, and key connectors 140 quickly and easily reinserted between adjacent panels to join them.

What is claimed is:

1. A panel assembly for use in a staging platform formed by a selected number of said panel assemblies, said panel assembly comprising:

a horizontally disposed panel member having a central region, an upper surface, a lower surface parallel to said upper surface and a periphery; and a panel member cladding frame affixed to said panel member along said periphery and attached to and extending from said lower surface, to thereby support said periphery of said panel member, said cladding frame comprising:

upper and lower flanges generally parallel to each other and to said panel member upper surface and lower surface with said upper flange engaging said lower surface of said panel member, and said lower flange disposed below and spaced from said upper flange, and a web extending generally perpendicularly between and connecting said flanges, said web having a panel facing side and an exposed side, said cladding frame further including a channel at said exposed side adjacent said upper flange, said channel having a channel base extending perpendicularly from said web at a location between said upper and lower flanges and channel legs projecting upwardly from said channel base and downwardly from said upper flange so as to form a lateral opening into said channel.

2. The panel assembly according to claim 1, wherein said panel member is formed to material having a relatively lower density than said cladding frame.

3. The panel assembly according to claim 2, wherein said web further comprises a hollow core between said panel facing side and said exposed side.

* * * * *

UNITED STATES PATENT AND TRADEMARK OFFICE

CERTIFICATE OF CORRECTION

PATENT NO. : 5,205,087

DATED : April 27, 1993

INVENTOR(S) : Michael D. Jines

It is certified that error appears in the above-identified patent and that said Letters Patent is hereby corrected as shown below:

Column 6, line 31, Delete the word "to" and substitute therefor --of--.

Signed and Sealed this

First Day of March, 1994

*Attest:*

*Attesting Officer*

Bruce Lehman

BRUCE LEHMAN

*Commissioner of Patents and Trademarks*